US011391166B2

(12) United States Patent
Lutz

(10) Patent No.: US 11,391,166 B2
(45) Date of Patent: Jul. 19, 2022

(54) DOVETAIL SLOT FOR USE WITH ROTOR ASSEMBLIES

(71) Applicant: GENERAL ELECTRIC TECHNOLOGY GMBH, Baden (CH)

(72) Inventor: Thomas Lutz, Baden (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 0 days.

(21) Appl. No.: 17/055,243

(22) PCT Filed: May 8, 2019

(86) PCT No.: PCT/EP2019/061782
§ 371 (c)(1),
(2) Date: Nov. 13, 2020

(87) PCT Pub. No.: WO2019/219473
PCT Pub. Date: Nov. 21, 2019

(65) Prior Publication Data

US 2021/0222573 A1 Jul. 22, 2021

(30) Foreign Application Priority Data

May 16, 2018 (EP) ..... 18172700

(51) Int. Cl.
*F01D 5/30* (2006.01)

(52) U.S. Cl.
CPC ..... *F01D 5/3007* (2013.01)

(58) Field of Classification Search
CPC ..... F01D 5/3007; F05D 2220/31; F05D 2260/961
See application file for complete search history.

(56) References Cited

U.S. PATENT DOCUMENTS

| | | | | |
|---|---|---|---|---|
| 4,260,331 | A * | 4/1981 | Goodwin | F01D 5/3007 416/219 R |
| 5,474,421 | A * | 12/1995 | Rossmann | F01D 5/3007 416/203 |
| 8,079,817 | B2 * | 12/2011 | Lagrange | F01D 5/3007 416/219 R |
| 8,210,822 | B2 * | 7/2012 | DeMania | F01D 5/3007 416/219 R |
| 2009/0022591 | A1 * | 1/2009 | Mujezinovic | F01D 5/3007 416/219 R |
| 2017/0122117 | A1 * | 5/2017 | Trappier | F01D 5/3007 |

FOREIGN PATENT DOCUMENTS

EP 2441917 A1 4/2012

* cited by examiner

*Primary Examiner* — Justin D Seabe
*Assistant Examiner* — Eric A Lange
(74) *Attorney, Agent, or Firm* — Grogan, Tuccillo & Vanderleeden, LLP

(57) ABSTRACT

A turbine wheel is disclosed. The turbine wheel includes a plurality of first dovetail slots (300) and a plurality of second dovetail slots (100). The plurality of first dovetail slots and the plurality of second dovetail slots are alternately spaced circumferentially on a radially outer periphery of the turbine wheel (200). And a rotor assembly (600) is disclosed. The rotor assembly is used with the turbine wheel a plurality of first turbine buckets (700) and a plurality of second turbine buckets (800).

20 Claims, 6 Drawing Sheets

DOVETAIL SLOT FOR USE WITH ROTOR ASSEMBLIES

BACKGROUND

The present disclosure relates generally to a rotor assembly and more particularly relates to a rotor assembly including intentionally frequency mistuned turbine buckets.

A turbine bucket, also known as a rotating turbine blade or turbine rotor blade, converts energy from a flowing fluid such as hot combustion gas or steam into mechanical energy by causing a shaft of a turbomachine to rotate. As the turbomachine transitions through various operating modes, the turbine blades are subjected to both mechanical and thermal stresses.

Steam turbine buckets are operated in an environment where they are subject to high centrifugal loads and vibratory stresses. In the process of operation, flutter, i.e., self-excited vibrations of turbine buckets, can lead to catastrophic failures in turbine components. Flutter is an aeroelastic instability that results from coupling between aerodynamic and inertial forces. This interaction causes unsteady aerodynamic forces acting on the turbine buckets, which leads to vibrations. The vibrations may cause structural failure. As such, the flow rate and pressure of steam turbine are limited to prevent flutter, which restricts the power output and efficiency of steam turbine.

One known method for reducing flutter is to change the natural frequency of turbine buckets by precisely removing material from one of two adjacent turbine buckets, which requires expensive machining of the turbine buckets, results in wasted raw material and reduces the efficiency of the steam turbine.

Thus, an improved rotor assembly, for example, a rotor assembly including improved intentionally frequency mistuned turbine buckets, would be desired in the art.

BRIEF DESCRIPTION OF THE DRAWINGS

The above and other aspects, features, and advantages of the present disclosure will become more apparent in light of the subsequent detailed description when taken in conjunction with the accompanying drawings in which.

DETAILED DESCRIPTION

One or more embodiments of the present disclosure will be described below. Unless defined otherwise, technical and scientific terms used herein have the same meaning as is commonly understood by one of skill in the art to which this disclosure belongs. The terms "a" and "an" do not denote a limitation of quantity, but rather denote the presence of at least one of the referenced items. Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. Additionally, when using an expression of "about a first value-a second value," the about is intended to modify both values. In at least some instances, the approximating language may correspond to the precision of an instrument for measuring the value. Here, and throughout the specification and claims, range limitations may be combined and/or interchanged, such ranges are identified and include all the sub-ranges contained therein unless context or language indicates otherwise.

Figure 1:
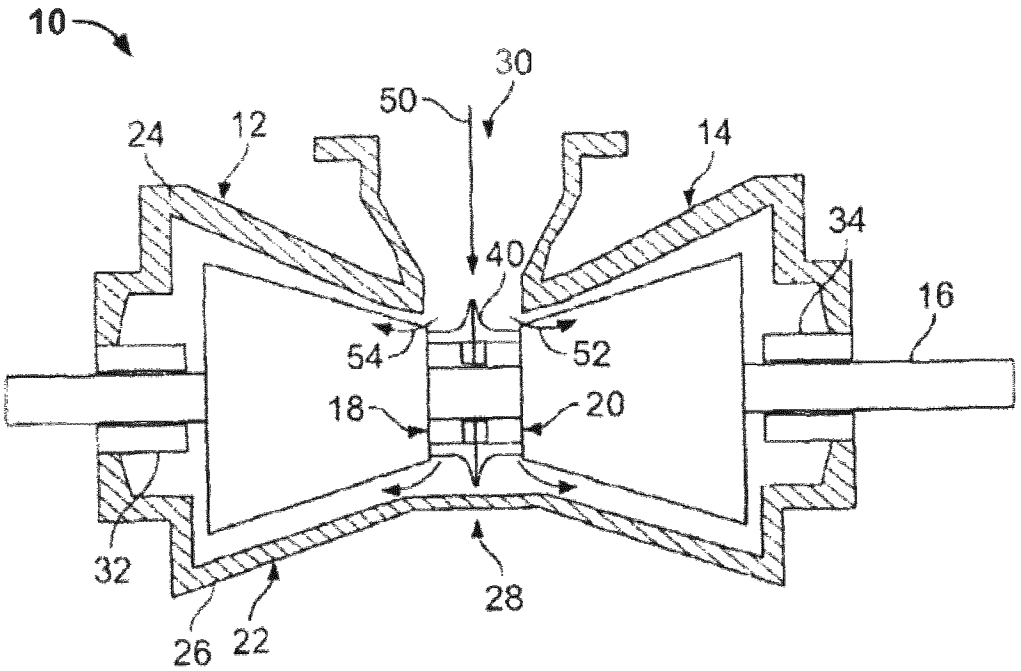
FIG. 1 is a schematic diagram of an exemplary opposed-flow steam turbine according to one embodiment of the present disclosure.

FIG. 1 is a schematic illustration of an exemplary opposed-flow steam turbine 10. The steam turbine 10 includes first and second low pressure (LP) sections 12 and 14. As is known in the art, each of turbine sections 12 and 14 includes a plurality of stages of diaphragms (not shown in FIG. 1). A rotor shaft 16 extends through first and second low pressure (LP) sections 12 and 14. Each of LP sections 12 and 14 includes a nozzle 18 and 20. A single outer shell or casing 22 is divided along a horizontal plane and axially into upper and lower half sections 24 and 26, respectively, and spans both first and second low pressure (LP) sections 12 and 14. A central section 28 of single outer shell or casing 22 includes a low pressure steam inlet 30. Within the single outer shell or casing 22, first and second low pressure (LP) sections 12 and 14 are arranged in a single bearing span supported by journal bearings 32 and 34. A flow splitter 40 extends between the first and second turbine sections 12 and 14.

During operation, the low pressure steam inlet 30 receives low pressure/intermediate temperature steam 50 from a source, such as, but not limited to, an HP turbine or IP turbine through a cross-over pipe (not shown). The steam 50 is channeled through the inlet 30 wherein the flow splitter 40 splits the steam flow into two opposite flow paths 52 and 54. More specifically, in the exemplary embodiment, the steam 50 is routed through LP sections 12 and 14 wherein work is extracted from the steam 50 to rotate rotor shaft 16. The steam 50 exits LP sections 12 and 14 and is routed to a condenser, for example.

It should be noted that although FIG. 1 illustrates an opposed-flow, low pressure turbine, as will be appreciated by one of ordinary skill in the art, the present invention is not limited to being used only with low pressure turbines and can be used with any opposed-flow turbine including, but not limited to intermediate pressure (IP) turbines and/or high pressure (HP) turbines. In addition, the present invention is not limited to only being used with opposed-flow turbines, but rather may also be used with single flow steam turbines as well, for example.

Figure 2:
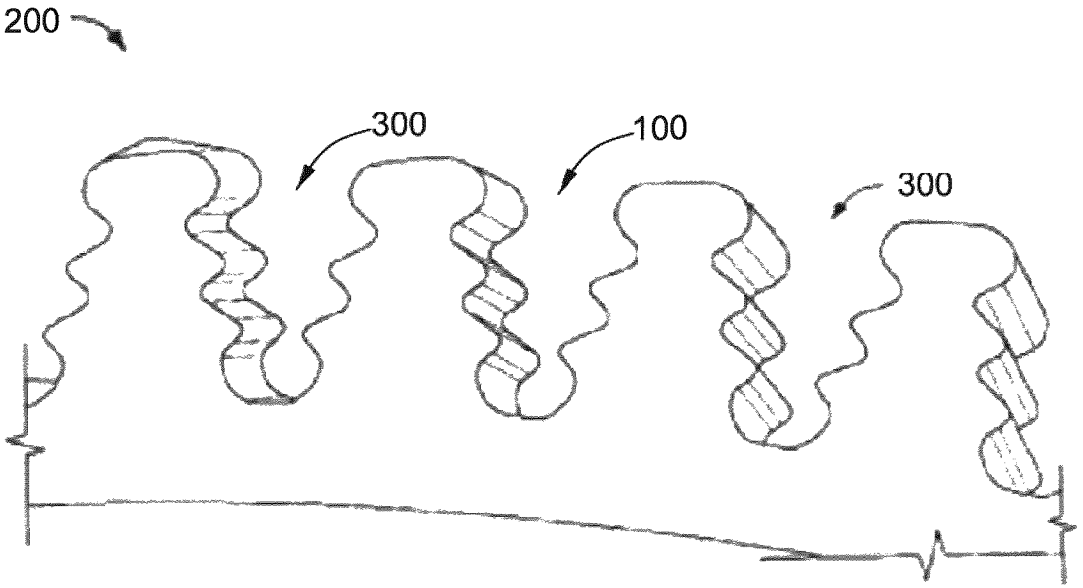
FIG. 2 is an illustration of a portion of an exemplary turbine wheel used in the steam turbine of FIG. 1, according to one embodiment of the present disclosure.

FIG. 2 is an illustration of a portion of an exemplary turbine wheel 200 that may be used in the steam turbine 10. The turbine wheel 200 includes a plurality of first dovetail slots 300 and a plurality of second dovetail slots 100 different from the first dovetail slot 300. More specifically, the plurality of first dovetail slots 300 and the plurality of second dovetail slots 100 are alternately spaced circumferentially on a radially outer periphery of the turbine wheel 200, and are shaped and sized to receive an attachment portion therein.

Figure 3:
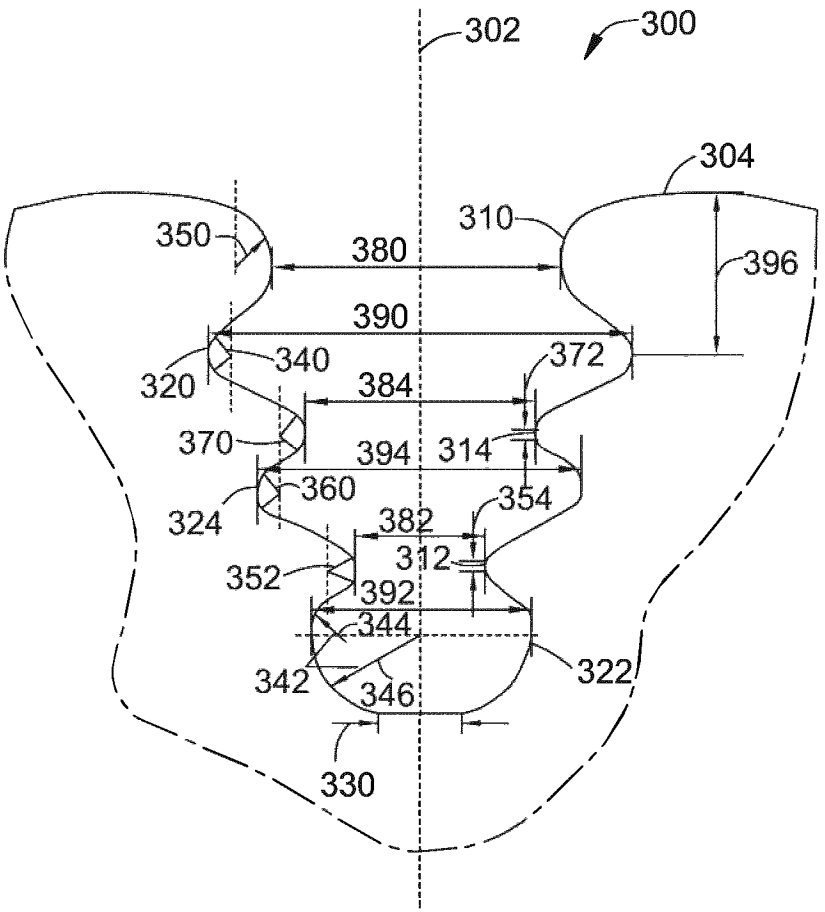
FIG. 3 is a schematic view of an exemplary first dovetail slot according to one embodiment of the present disclosure.

FIG. 3 is a schematic view showing the first dovetail slot 300 in greater detail. In the exemplary embodiment, the first dovetail slot 300 is symmetric about a centerline 302. Alternative embodiments may alter the location of each element described below in relation to the centerline 302. The first dovetail slot 300 includes a plurality of hook fillets and a plurality of neck fillets. In some embodiments, the first dovetail slot may include three, four, five or more neck fillets and hook fillets. Specifically, in the exemplary embodiment, the first dovetail slot 300 includes a first top hook fillet 310, a first top neck fillet 320, a first bottom hook fillet 312, a first bottom neck fillet 322 and a first bottom flat surface 330 arranged from top to bottom.

In the exemplary embodiment, the first top neck fillet 320 is formed with a radius 340. In the exemplary embodiment, the radius 340 measures between 1.690 millimeters (mm) and 2.706 mm or, more specifically, approximately 2.198 mm. The first bottom neck fillet 322 is formed with a compound radius 342. In the exemplary embodiment, the compound radius 342 includes two radii 344 and 346. Specifically, in the exemplary embodiment, the radius 344 measures between 1.69 millimeters (mm) and 2.706 mm or, more specifically, approximately 2.198 mm. The radius 346 measures between 5.776 millimeters (mm) and 10.348 mm or, more specifically, approximately 8.062 mm. In alternative embodiments, the first top neck fillet or first bottom neck fillet may include different radius measurements, or the first bottom neck fillet may include only a single radius.

In the exemplary embodiment, the first top hook fillet 310 includes a radius 350 which, in the exemplary embodiment, measures between 1.255 millimeters (mm) and 5.827 mm or, more specifically, approximately 3.541 mm. Alternative embodiments may use a different radius for the first top hook fillet 310. Radius 350 is designed to facilitate a smooth transition between the first dovetail slot 300 and a turbine wheel surface 304. The first bottom hook fillet 312 is formed with two identical radii 352 and a flat surface 354 extending therebetween. In the exemplary embodiment, each radius 352 measures between 0.425 millimeters (mm) and 1.441 mm or, more specifically, approximately 0.933 mm. The flat surface 354 measures between 0.500 millimeters (mm) and 3.707 mm or, more specifically, approximately 0.663 mm. Alternative embodiments may use one or more flat surfaces having different lengths. Further, alternative embodiments may use a different radius or may use two different radii.

In some embodiments, the first dovetail slot 300 may further include a first middle hook fillet 314 and a first middle neck fillet 324, arranged from top to bottom between the first top neck fillet 320 and the first bottom hook fillet 312. The first middle neck fillet 324 is formed with a radius 360. In the exemplary embodiment, the radius 360 is identical and measures between 1.690 millimeters (mm) and 2.706 mm or, more specifically, approximately 2.198 mm. Alternative embodiments may vary the radius of each neck. The first middle hook fillet 314 is formed with two identical radii 370 and a flat surface 372 extending therebetween. In the exemplary embodiment, each radius 370 measures between 1.604 millimeters (mm) and 2.62 mm or, more specifically, approximately 2.112 mm. The flat surface 372 measures between 0.250 millimeters (mm) and 3.393 mm or, more specifically, approximately 0.853 mm. Alternative embodiments may use one or more flat surfaces having a different length. Further, alternative embodiments may use a different radius or may use two different radii.

Figure 4:
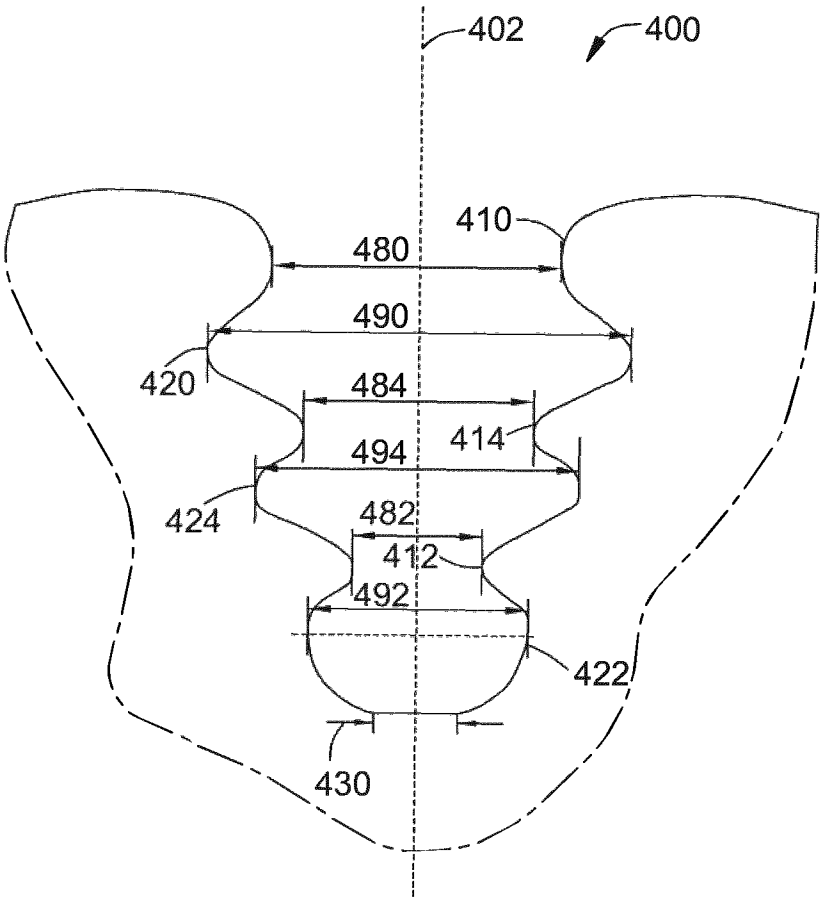
FIG. 4 is a schematic view of an exemplary second dovetail slot according to one embodiment of the present disclosure.

The second dovetail slot 100 in wheel 200 of FIG. 2 may be formed in various configurations. For example, FIG. 4 is a schematic view of an exemplary second dovetail slot 400, as a specific embodiment of the second dovetail slot 100 in FIG. 2. In the exemplary embodiment, the second dovetail slot 400 is symmetric about centerline 402. Alternative embodiments may alter the location of each element described below in relation to centerline 402. The second dovetail slot 400 includes a plurality of hook fillets and a plurality of neck fillets. In some embodiments, the second dovetail slot may include three, four, five or more neck fillets and hook fillets. Specifically, in the exemplary embodiment, the second dovetail slot 400 includes a second top hook fillet 410, a second top neck fillet 420, a second bottom hook fillet 412, a second bottom neck fillet 422 and a second bottom flat surface 430 arranged from top to bottom. The second dovetail slot 400 may further include a second middle hook fillet 414 and a second middle neck fillet 424, the second middle hook fillet 414 and the second middle neck fillet 424 arranged from top to bottom between the second top neck fillet 420 and the second bottom hook fillet 412. The geometric construction of the second dovetail slot 400 is similar to the first dovetail slot 300.

In the illustrated example as shown in FIGS. 3 & 4, a top hook opening width difference between a minimum opening width 380 of the first top hook fillet 310 and a minimum opening width 480 of the second top hook fillet 410 being linear to a bottom hook opening width difference between a minimum opening width 382 of the first bottom hook fillet 312 and a minimum opening width 482 of the second bottom hook fillet 412. In some embodiments, the top hook opening width difference is linear to a middle hook opening width difference between a minimum opening width 384 of the first middle hook fillet 314 and a minimum opening width 484 of the second middle hook fillet 414.

In some embodiments, a top neck opening width difference between a maximum opening width 390 of the first top neck fillet 320 and a maximum opening width 490 of the second top neck fillet 420 is linear to a bottom neck opening width difference between a maximum opening width 392 of the first bottom neck fillet 322 and a maximum opening width 492 of the second bottom neck fillet 422. In some embodiments, the top neck opening width difference is linear to a middle neck opening width difference between a maximum opening width 394 of the first middle neck fillet 324 and a maximum opening width 494 of the second middle neck fillet 424.

In some embodiments, the hook opening width difference is linear to the top neck opening width difference.

In some embodiments, the top hook opening width difference is linear to a bottom surface width difference between a width of the first bottom flat surface 330 and a width of the second bottom flat surface 430.

In the exemplary embodiment, the top hook opening width difference, the middle hook opening width difference and the bottom hook opening width difference are equal. In some embodiments, the top neck opening width difference, the middle neck opening width difference, and the bottom neck opening width difference are equal.

Further, two of the top hook opening width difference, the middle hook opening width difference, the bottom hook opening width difference, the top neck opening width difference, the middle neck opening width difference, the bottom neck opening width difference and the bottom surface width difference may be equal in some embodiments. In the exemplary embodiment, all the differences are between 2 millimeters (mm) and 20 mm or, more specifically, approximately 10 mm, or approximately 5 mm.

Figure 5:
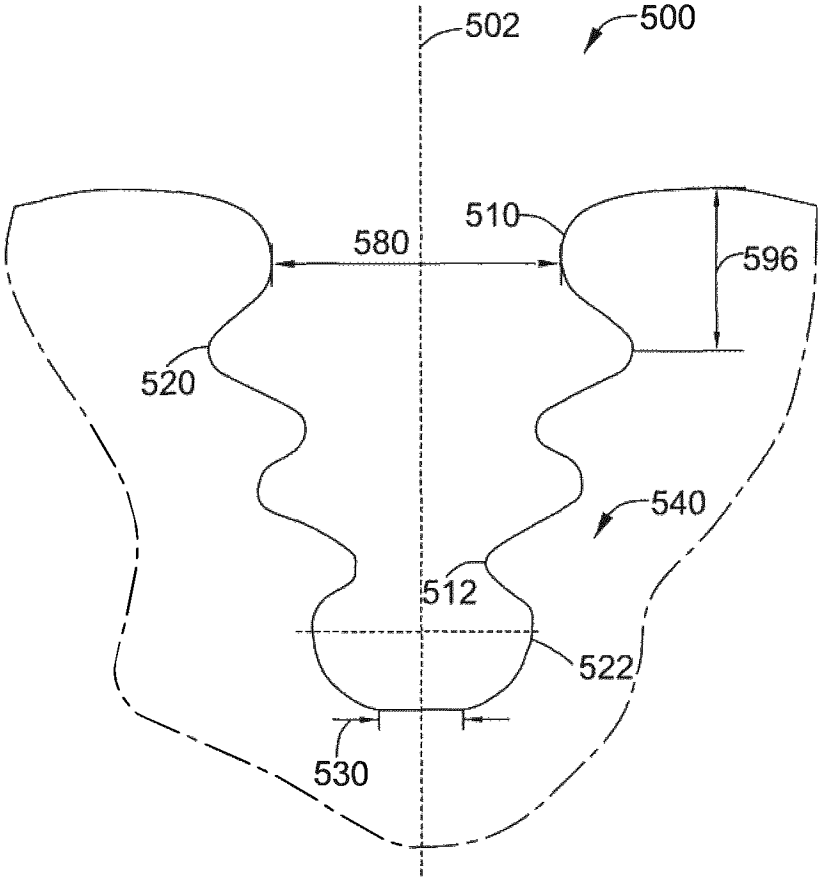
FIG. 5 is a schematic view of an exemplary second dovetail slot according to another embodiment of the present disclosure.

FIG. 5 is a schematic view of an exemplary second dovetail slot 500, as another specific embodiment of the second dovetail slot 100 in FIG. 2. In the exemplary embodiment, the second dovetail slot 500 is symmetric about centerline 502. Alternative embodiments may alter the location of each element described below in relation to centerline 502. The second dovetail slot 500 includes a plurality of hook fillets and a plurality of neck fillets. In some embodiments, the second dovetail slot may include three, four, five or more neck fillets and hook fillets. Specifically, in the exemplary embodiment, the second dovetail slot 500 includes a second top hook fillet 510, a second top neck fillet 520, and a second bottom portion 540 arranged from top to bottom, the second bottom portion 540 comprising a second bottom hook fillet 512, a second bottom neck fillet 522 and a second bottom flat surface 530 arranged from top to bottom. The geometric construction of the second dovetail slot 500 is similar to the first dovetail slot 300.

In the illustrated example as shown in FIGS. 3 & 5, the second bottom portion 540 being geometrically substantially same as the bottom portion of the first dovetail slot 300, and the second top hook fillet 510 being geometrically difference from the first top hook fillet 310 of the first dovetail slot 300. In some embodiments, a minimum opening width 380 of the first top hook fillet 310 is difference from the minimum opening width 580 of the second top hook fillet 510. In some embodiments, a height 396 of the first top hook fillet 310 is difference from a height 596 of the second top hook fillet 510.

Figure 6:
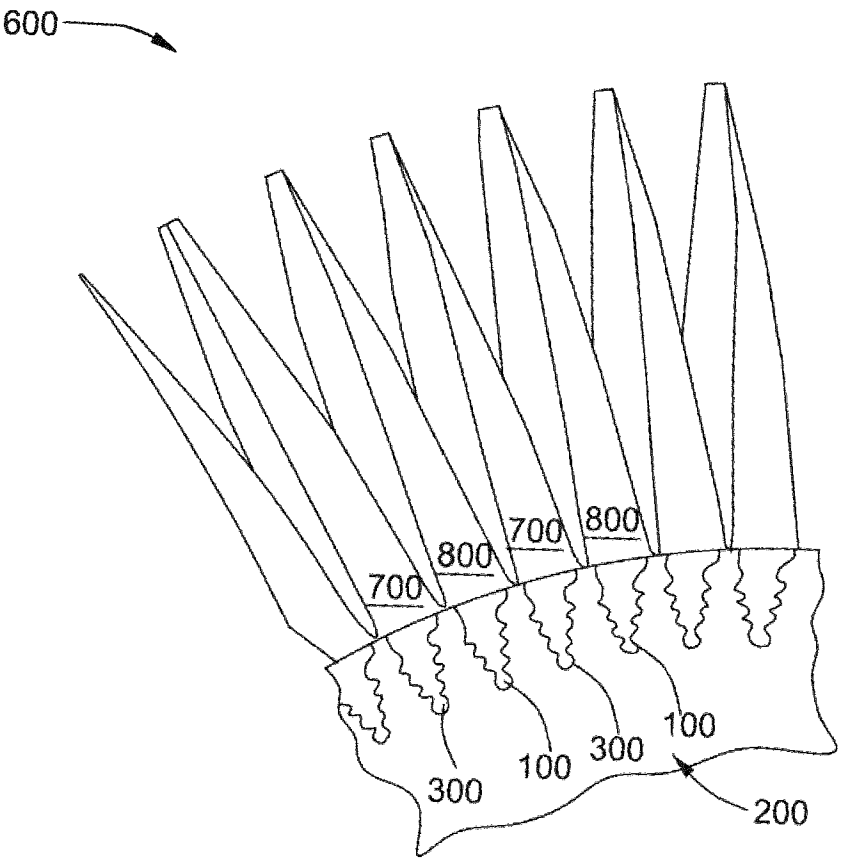
FIG. 6 is an illustration of a portion of an exemplary rotor assembly according to one embodiment of the present disclosure.

FIG. 6 is an illustration of a portion of an exemplary rotor assembly 600 that may be used with the turbine wheel 200, a plurality of first turbine buckets 700 and a plurality of second turbine buckets 800. The first turbine buckets and the second turbine buckets may be free-standing buckets. The first turbine bucket 700 includes a first dovetail, a first airfoil portion and a first root extending between the first airfoil portion and the first root, the first turbine bucket 700 is coupled within the first dovetail slot 300. The second turbine bucket 800 includes a second dovetail, a second airfoil portion and a second root extending between the second airfoil portion and the second root, the second turbine bucket 800 is coupled within the second dovetail slot 100.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Various aspects and embodiments of the present invention will now be defined by the following numbered clauses:

1. A turbine wheel (200), comprising:
a plurality of first dovetail slots (300), at least one of the plurality of first dovetail slots (300) comprising a first top hook fillet (310), a first top neck fillet (320), a first bottom hook fillet (312), a first bottom neck fillet (322) and a first bottom flat surface (330) arranged from top to bottom; and
a plurality of second dovetail slots (100, 400, 500), at least one of the plurality of second dovetail slots (100, 400, 500) comprising a second top hook fillet (410, 510), a second top neck fillet (420, 520), a second bottom hook fillet (412, 512), a second bottom neck fillet (422, 522) and a second bottom flat surface (430, 530) arranged from top to bottom; wherein the plurality of first dovetail slots (300) and the plurality of second dovetail slots (100, 400, 500) are alternately spaced circumferentially on a radially outer periphery of the turbine wheel (200), and a top hook opening width difference between a minimum opening width (380) of the first top hook fillet (310) and a minimum opening width (480, 580) of the second top hook fillet (410, 510) being linear to a bottom hook opening width difference between a minimum opening width (382) of the first bottom hook fillet (312) and a minimum opening width (482) of the second bottom hook fillet (412, 512).

2. The turbine wheel (200) of clause 1, wherein at least one of the plurality of first dovetail slots (300) further comprising a first middle hook fillet (314) and a first middle neck fillet (324), the first middle hook fillet (314) and the first middle neck fillet (324) arranged from top to bottom between the first top neck fillet (320) and the first bottom hook fillet (312).

3. The turbine wheel (200) of clause 2, wherein at least one of the plurality of second dovetail slots (100, 400, 500) further comprising a second middle hook fillet (414) and a second middle neck fillet (424), the second middle hook fillet (414) and the second middle neck fillet (424) arranged from top to bottom between the second top neck fillet (420, 520) and the second bottom hook fillet (412, 512).

4. The turbine wheel (200) of clause 3, wherein the top hook opening width difference is linear to a middle hook opening width difference between a minimum opening width (384) of the first middle hook fillet (314) and a minimum opening width (484) of the second middle hook fillet (414).

5. The turbine wheel (200) of clause 1, wherein a top neck opening width difference between a maximum opening width (390) of the first top neck fillet (320) and a maximum opening width (490) of the second top neck fillet (420, 520) is linear to a bottom neck opening width difference between a maximum opening width (392) of the first bottom neck fillet (322) and a maximum opening width (492) of the second bottom neck fillet (422, 522).

6. The turbine wheel (200) of clause 3, wherein a top neck opening width difference between a maximum opening width (390) of the first top neck fillet (320) and a maximum opening width (490) of the second top neck fillet (420, 520) is linear to a middle neck opening width difference between a maximum opening width (394) of the first middle neck fillet (324) and a maximum opening width (494) of the second middle neck fillet (424).

7. The turbine wheel (200) of clause 1, wherein the top hook opening width difference is linear to a top neck opening width difference between a maximum opening width (390) of the first top neck fillet (320) and a maximum opening width (490) of the second top neck fillet (420, 520).

8. The turbine wheel (200) of clause 1, wherein the top hook opening width difference is linear to a bottom surface width difference between a width of the first bottom flat surface (330) and a width of the second bottom flat surface (430, 530).

9. The turbine wheel (200) of clause 4, wherein the top hook opening width difference, the middle hook opening width difference and the bottom hook opening width difference are equal.

10. The turbine wheel (200) of clause 1, wherein the turbine wheel (200) is in a steam turbine (10).

11. A rotor assembly (600), comprising:
a plurality of first turbine buckets (700), at least one of the plurality of first turbine buckets (700) comprising a first dovetail, a first airfoil portion and a first root extending between the first airfoil portion and the first root;

a plurality of second turbine buckets (800), at least one of the plurality of second turbine buckets (800) comprising a second dovetail, a second airfoil portion and a second root extending between the second airfoil portion and the second root;

a turbine wheel (200) for use with the turbine buckets (700, 800), the turbine wheel (200) comprising:

a plurality of first dovetail slots (300), at least one of the plurality of first dovetail slots (300) comprising a first top hook fillet (310), a first top neck fillet (320), a first bottom hook fillet (312), a first bottom neck fillet (322) and a first bottom flat surface (330) arranged from top to bottom; and a plurality of second dovetail slots (100, 400, 500), at least one of the plurality of second dovetail slots (100, 400, 500) comprising a second top hook fillet (410, 510), a second top neck fillet (420, 520), a second bottom hook fillet (412, 512), a second bottom neck fillet (422, 522) and a second bottom flat surface (430, 530) arranged from top to bottom; wherein the plurality of first dovetail slots (300) and the plurality of second dovetail slots (100, 400, 500) are alternately spaced circumferentially on a radially outer periphery of the turbine wheel (200), and a top hook opening width difference between a minimum opening width (380) of the first top hook fillet (310) and a minimum opening width (480, 580) of the second top hook fillet (410, 510) being linear to a bottom hook opening width difference between a minimum opening width (382) of the first bottom hook fillet (312) and a minimum opening width (482) of the second bottom hook fillet (412, 512);

wherein the first turbine bucket (700) is coupled within the first dovetail slot (300), and the second turbine bucket (800) is coupled within the second dovetail slot (100, 400, 500).

12. The rotor assembly (600) of clause 11, wherein at least one of the plurality of first dovetail slots (300) further comprising a first middle hook fillet (314) and a first middle neck fillet (324), the first middle hook fillet (314) and the first middle neck fillet (324) arranged from top to bottom between the first top neck fillet (320) and the first bottom hook fillet (312).

13. The rotor assembly (600) of clause 11, wherein at least one of the plurality of second dovetail slots (100, 400, 500) further comprising a second middle hook fillet (414) and a second middle neck fillet (424), the second middle hook fillet (414) and the second middle neck fillet (424) arranged from top to bottom between the second top neck fillet (420, 520) and the second bottom hook fillet (412, 512).

14. The rotor assembly (600) of clause 13, wherein the top hook opening width difference is linear to a middle hook opening width difference between a minimum opening width (384) of the first middle hook fillet (314) and a minimum opening width (484) of the second middle hook fillet (414).

15. The rotor assembly (600) of clause 11, wherein the top hook opening width difference, the bottom hook opening width difference and a middle hook opening width difference between a minimum opening width (384) of the first middle hook fillet (314) and a minimum opening width (484) of the second middle hook fillet (414) are equal.

16. The rotor assembly (600) of clause 11, wherein the first turbine buckets (700) and the second turbine buckets (800) are free-standing buckets.

17. The rotor assembly (600) of clause 11, wherein the rotor assembly (600) is in a steam turbine (10).

18. A turbine wheel (200), comprising:

a plurality of first dovetail slots (300), at least one of the plurality of first dovetail slots (300) comprising a first top hook fillet (310), a first top neck fillet (320), and a first bottom portion arranged from top to bottom, the first bottom portion comprising a first bottom hook fillet (312), a first bottom neck fillet (322) and a first bottom flat surface (330) arranged from top to bottom; and a plurality of second dovetail slots (100, 400, 500), at least one of the plurality of second dovetail slots (100, 400, 500) comprising a second top hook fillet (410, 510), a second top neck fillet (420, 520), and a second bottom portion (540) arranged from top to bottom, the second bottom portion (540) comprising a second bottom hook fillet (412, 512), a second bottom neck fillet (422, 522) and a second bottom flat surface (430, 530) arranged from top to bottom;

wherein the plurality of first dovetail slots (300) and the plurality of second dovetail slots (100, 400, 500) are alternately spaced circumferentially on a radially outer periphery of the turbine wheel (200), the first bottom portion being geometrically substantially same as the second bottom portion (540), and the a first top hook fillet (310) being geometrically difference from the second top hook fillet (410, 510).

19. The turbine wheel (200) of clause 18, wherein a minimum opening width (380) of the first top hook fillet (310) is difference from a minimum opening width (480, 580) of the second top hook fillet (410, 510).

20. The turbine wheel (200) of clause 18, wherein a height of the first top hook fillet (310) is difference from a height of the second top hook fillet (410, 510).

The invention claimed is:

1. A turbine wheel, comprising:

a plurality of first dovetail slots, at least one of the plurality of first dovetail slots comprising a first top hook fillet having a minimum opening width, a first top neck fillet having a maximum opening width, a first bottom hook fillet having a minimum opening width, a first bottom neck fillet having a maximum opening width, and a first bottom flat surface arranged from top to bottom, wherein the minimum opening width of the first top hook fillet transitions to the maximum opening width of the first top neck fillet, wherein the maximum opening width of the first top neck fillet transitions to the minimum opening width of the first bottom hook fillet, wherein the minimum opening width of the first bottom hook fillet transitions to the maximum opening width of the first bottom neck fillet, wherein the maximum opening width of the first bottom neck fillet transitions to the first bottom flat surface; and a plurality of second dovetail slots, at least one of the plurality of second dovetail slots comprising a second top hook fillet having a minimum opening width, a second top neck fillet having a maximum opening width, a second bottom hook fillet having a minimum opening width, a second bottom neck fillet having a maximum opening width, and a second bottom flat surface arranged from top to bottom, wherein the minimum opening width of the second top hook fillet transitions to the maximum opening width of the second top neck fillet, wherein the maximum opening width of the second top neck fillet transitions to the minimum opening width of the second bottom hook fillet, wherein the minimum opening width of the second bottom hook fillet transitions to the maximum opening width of the second bottom neck fillet, wherein the maximum opening width of the second bottom neck fillet transitions to the second bottom flat surface;

wherein the plurality of first dovetail slots and the plurality of second dovetail slots are alternately spaced circumferentially on a radially outer periphery of the turbine wheel;

wherein a top hook opening width difference between the plurality of the first dovetail slots and the plurality of the second dovetail slots is defined between the minimum opening width of the first top hook fillet and the minimum opening width of the second top hook fillet, wherein a bottom hook opening width difference between the plurality of the first dovetail slots and the plurality of the second dovetail slots is defined between the minimum opening width of the first bottom hook fillet and the minimum opening width of the second bottom hook fillet;

wherein a bottom portion of the at least one of the plurality of the first dovetail slots defined by the first bottom neck fillet and the first bottom flat surface is geometrically the same as a bottom portion of the at least one of the plurality of the second dovetail slots defined by the second bottom neck fillet and the second bottom flat surface; and wherein the first top hook fillet of the at least one of the plurality of the first dovetail slots is geometrically different than the second top hook fillet of the at least one of the plurality of the second dovetail slots.

2. The turbine wheel of claim 1, wherein the top hook opening width difference between the plurality of the first dovetail slots and the plurality of the second dovetail slots transitions to a top neck opening width difference between the plurality of the first dovetail slots and the plurality of the second dovetail slots that is defined between the maximum opening width of the first top neck fillet and the maximum opening width of the second top neck fillet.

3. The turbine wheel of claim 1, wherein the top hook opening width difference between the plurality of the first dovetail slots and the plurality of the second dovetail slots transitions to a bottom surface width difference between the plurality of the first dovetail slots and the plurality of the second dovetail slots that is defined between the width of the first bottom flat surface and the width of the second bottom flat surface.

4. The turbine wheel of claim 1, wherein a top neck opening width difference between the plurality of the first dovetail slots and the plurality of the second dovetail slots is defined between the maximum opening width of the first top neck fillet and the maximum opening width of the second top neck fillet, wherein the top neck opening width difference transitions and to a bottom neck opening width difference between the plurality of the first dovetail slots and the plurality of the second dovetail slots that is defined between the maximum opening width of the first bottom neck fillet and the maximum opening width of the second bottom neck fillet.

5. The turbine wheel of claim 1, wherein at least one of the plurality of first dovetail slots further comprises a first middle hook fillet having a minimum opening width and a first middle neck fillet having a maximum opening width, the first middle hook fillet and the first middle neck fillet being arranged from top to bottom between the first top neck fillet and the first bottom hook fillet.

6. The turbine wheel of claim 5, wherein at least one of the plurality of second dovetail slots further comprising a second middle hook fillet having a minimum opening width and a second middle neck fillet having a maximum opening width, the second middle hook fillet and the second middle neck fillet being arranged from top to bottom between the second top neck fillet and the second bottom hook fillet.

7. The turbine wheel of claim 6, wherein a top neck opening width difference between the plurality of the first dovetail slots and the plurality of the second dovetail slots is defined between the maximum opening width of the first top neck fillet and the maximum opening width of the second top neck fillet, wherein the top neck opening width difference transitions to a middle neck opening width difference between the plurality of the first dovetail slots and the plurality of the second dovetail slots that is defined between the maximum opening width of the first middle neck fillet and the maximum opening width of the second middle neck fillet.

8. The turbine wheel of claim 6, wherein the top hook opening width difference between the plurality of the first dovetail slots and the plurality of the second dovetail slots transitions to a middle hook opening width difference between the plurality of the first dovetail slots and the plurality of the second dovetail slots that is defined between the minimum opening width of the first middle hook fillet and the minimum opening width of the second middle hook fillet.

9. The turbine wheel of claim 8, wherein the top hook opening width difference, the middle hook opening width difference, and the bottom hook opening width difference are equal.

10. The turbine wheel of claim 1, wherein the turbine wheel is in a steam turbine.

11. A rotor assembly, comprising:

a plurality of first turbine buckets, at least one of the plurality of first turbine buckets comprising a first dovetail, a first airfoil portion and a first root extending between the first airfoil portion and the first dovetail;

a plurality of second turbine buckets, at least one of the plurality of second turbine buckets comprising a second dovetail, a second airfoil portion and a second root extending between the second airfoil portion and the second dovetail; and a turbine wheel for use with the turbine buckets, the turbine wheel comprising:

a plurality of first dovetail slots, at least one of the plurality of first dovetail slots comprising a first top hook fillet having a minimum opening width, a first top neck fillet having a maximum opening width, a first bottom hook fillet having a minimum opening width, a first bottom neck fillet having a maximum opening width, and a first bottom flat surface arranged from top to bottom, wherein the minimum opening width of the first top hook fillet transitions to the maximum opening width of the first top neck fillet, wherein the maximum opening width of the first top neck fillet transitions to the minimum opening width of the first bottom hook fillet, wherein the minimum opening width of the first bottom hook fillet transitions to the maximum opening width of the first bottom neck fillet, wherein the maximum opening width of the first bottom neck fillet transitions to the first bottom flat surface; and a plurality of second dovetail slots, at least one of the plurality of second dovetail slots comprising a second top hook fillet having a minimum opening width, a second top neck fillet having a maximum opening width, a second bottom hook fillet having a maximum opening width, a second bottom neck fillet having a maximum opening width, and a second bottom flat surface arranged from top to bottom, wherein the minimum opening width of the second top hook fillet transitions to the maximum opening width of the second top neck fillet, wherein the maximum opening width of the second top neck fillet transitions to the minimum opening width of the second bottom hook fillet, wherein the minimum opening width of the second bottom hook fillet transitions to the maximum opening width of the second bottom neck fillet, wherein the maximum opening width of the second bottom neck fillet transitions to the second bottom flat surface;

wherein the plurality of first dovetail slots and the plurality of second dovetail slots are alternately spaced circumferentially on a radially outer periphery of the turbine wheel, wherein a top hook opening width difference between the plurality of the first dovetail slots and the plurality of the second dovetail slots is defined between the minimum opening width of the first top hook fillet and the minimum opening width of the second top hook fillet, wherein a bottom hook opening width difference between the plurality of the first dovetail slots and the plurality of the second dovetail slots is defined between the minimum opening width of the first bottom hook fillet and the minimum opening width of the second bottom hook fillet;

wherein a bottom portion of the at least one of the plurality of the first dovetail slots defined by the first bottom neck fillet and the first bottom flat surface is geometrically the same as a bottom portion of the at least one of the plurality of the second dovetail slots defined by the second bottom neck fillet and the second bottom flat surface;

wherein the first top hook fillet of the at least one of the plurality of the first dovetail slots is geometrically different than the second top hook fillet of the at least one of the plurality of the second dovetail slots; and wherein the at least one of the plurality of first turbine buckets is coupled within a respective first dovetail slot of the plurality of first dovetail slots, and the at least one of the plurality of second turbine buckets is coupled within a respective second dovetail slot of the plurality of second dovetail slots.

12. The rotor assembly of claim 11, wherein at least one of the plurality of first dovetail slots further comprises a first middle hook fillet having a minimum opening width and a first middle neck fillet having a maximum opening width, the first middle hook fillet and the first middle neck fillet arranged from top to bottom between the first top neck fillet and the first bottom hook fillet.

13. The rotor assembly of claim 12, wherein at least one of the plurality of second dovetail slots further comprises a second middle hook fillet having a minimum opening width and a second middle neck fillet having a maximum opening width, the second middle hook fillet and the second middle neck fillet arranged from top to bottom between the second top neck fillet and the second bottom hook fillet.

14. The rotor assembly of claim 13, wherein the top hook opening width difference between the plurality of the first dovetail slots and the plurality of the second dovetail slots transitions to a middle hook opening width difference between the plurality of the first dovetail slots and the plurality of the second dovetail slots that is defined between the minimum opening width of the first middle hook fillet and the minimum opening width of the second middle hook fillet.

15. The rotor assembly of claim 14, wherein the top hook opening width difference, the bottom hook opening width difference, and the middle hook opening width difference between the plurality of the first dovetail slots and the plurality of the second dovetail slots are equal.

16. The rotor assembly of claim 11, wherein each of the plurality of first turbine buckets and each of the plurality of second turbine buckets is a free-standing bucket.

17. The rotor assembly of claim 11, wherein the rotor assembly is in a steam turbine.

18. A turbine wheel, comprising:

a plurality of first dovetail slots, at least one of the plurality of first dovetail slots comprising a first top hook fillet having a minimum opening width, a first top neck fillet having a maximum opening width, and a first bottom portion arranged from top to bottom, the first bottom portion comprising a first bottom hook fillet having a minimum opening width, a first bottom neck fillet having a maximum opening width, and a first bottom flat surface arranged from top to bottom; and a plurality of second dovetail slots, at least one of the plurality of second dovetail slots comprising a second top hook fillet having a minimum opening width, a second top neck fillet having a maximum opening width, and a second bottom portion arranged from top to bottom, the second bottom portion comprising a second bottom hook fillet having a minimum opening width, a second bottom neck fillet having a maximum opening width, and a second bottom flat surface arranged from top to bottom;

wherein the plurality of first dovetail slots and the plurality of second dovetail slots are alternately spaced circumferentially on a radially outer periphery of the turbine wheel, the first bottom portion being geometrically the same as the second bottom portion, and the first top hook fillet being geometrically different from the second top hook fillet.

19. The turbine wheel of claim 18, wherein a minimum opening width of the first top hook fillet is different from a minimum opening width of the second top hook fillet.

20. The turbine wheel of claim 18, wherein a height of the first top hook fillet is different from a height of the second top hook fillet.

* * * * *